US006089784A

United States Patent [19]

Ardern

[11] Patent Number: 6,089,784

[45] Date of Patent: Jul. 18, 2000

[54] GROUND-REINFORCEMENT PANELS, AND MULTI-PANEL, GROUND-DECKING ARRAYS INCORPORATING THEM

[76] Inventor: Fergus Johnathan Ardern, 16 Nursery Lane, Old Costessey, Norwich, Norfolk NR8 5BU, United Kingdom

[21] Appl. No.: 09/068,639

[22] PCT Filed: Nov. 14, 1996

[86] PCT No.: PCT/GB96/02801

§ 371 Date: Sep. 25, 1998

§ 102(e) Date: Sep. 25, 1998

[87] PCT Pub. No.: WO97/18353

PCT Pub. Date: May 22, 1997

[30] Foreign Application Priority Data

Nov. 14, 1995 [GB] United Kingdom ..... 9523310

[51] Int. Cl.[7] ..... E01C 5/00; E01C 5/18; E01C 5/20; F16B 7/00

[52] U.S. Cl. ..... 404/41; 404/34; 404/35; 404/36; 52/591.3; 403/52; 403/65; 403/375

[58] Field of Search ..... 404/41, 35, 36; 52/591.3, 592.2, 591.1, 590.2; 403/375, 378, 380, 395, 52, 65, 70, 389

[56] References Cited

U.S. PATENT DOCUMENTS

| | | | |
|---|---|---|---|
| 3,500,606 | 3/1970 | Wharmby | 52/591.1 |
| 4,289,818 | 9/1981 | Casamayor | 428/43 |
| 4,373,306 | 2/1983 | Rech | 52/98 |
| 5,836,125 | 11/1998 | Regina | 52/592.1 |

FOREIGN PATENT DOCUMENTS

| | | |
|---|---|---|
| 0 176 645 | 10/1984 | European Pat. Off. . |
| 0 286 395 | 10/1988 | European Pat. Off. . |
| 2240320 | 3/1975 | France . |
| 2536150 | 5/1984 | France . |
| 1509841 | 6/1969 | Germany . |
| 8632856 | 2/1986 | Germany . |
| 9421260 | 7/1995 | Germany . |
| 540398 | 9/1973 | Switzerland . |
| 666708 | 8/1988 | Switzerland . |
| 2101174 | 1/1983 | United Kingdom . |
| WO 9113208 | 9/1991 | WIPO . |

*Primary Examiner*—Eileen Dunn Lillis
*Assistant Examiner*—Raymond Addie
*Attorney, Agent, or Firm*—Synnestvedt & Lechner LLP

[57] ABSTRACT

In an articulated sequence or array of ground-reinforcement panels, each panel has parallel rectilinear edges, one of them provided with a number of male interlock members projecting therefrom in the plane of the panel and the other provided with a corresponding number of female interlock members recessed therein, so constructed and arranged that the male members can be forcibly but detachably interengaged with the female members in a next-adjacent panel in a direction vertical to the plane of the panels but cannot be disengaged therefrom in the plane of the panels, while, when interengaged, the respective male and female members and the adjacent panels associated therewith are capable of limited rotation with respect to each other.

17 Claims, 6 Drawing Sheets

GROUND-REINFORCEMENT PANELS, AND MULTI-PANEL, GROUND-DECKING ARRAYS INCORPORATING THEM

This invention relates to ground-reinforcement panels, and multi-panel, ground-decking arrays incorporating them.

There is a general requirement for temporary pathways, roadways, hard-standing areas and the like which has long been recognized. Perhaps there are other and even earlier instances, but one which comes to mind is the military need to be able quickly to construct adequate roadways, airfield runways or landing grounds even upon virgin ground. It is certainly more than fifty years since the British Army adopted pierced steel planking (so-called "PSP") for this kind of purpose, and it is possibly used to this day—but at best it is not an easy material to handle even when new and being laid for the first time, while its subsequent recovery and re-use is made at least difficult and quite often essentially impossible by the fact that heavy vehicular traffic passing over PSP deforms and otherwise damages it, often to a degree such that it is easier to discard rather than to re-use it.

When essentially new and undeformed, PSP can be supplied and applied to the ground surface in a continuous roll, but the more it is used (and thus the more it becomes deformed) the less chance there is that it can ever be recovered by simply rolling it up again.

It is also known to employ large stretches of relatively heavy-duty welded steel rod mesh, and this perhaps is less objectionable to handle. Even so, if subjected to heavy traffic this also becomes bowed or otherwise deformed—so that in any event there remains a problem of recovery. Anyway it is generally-speaking laid in successive sheets (which are overlapped with each other before being secured together and/or to the ground in order to form a roadway) so that laying this kind of ground reinforcement is basically a labour-intensive task which has to be performed manually rather than by simply unrolling the surface-reinforcing material onto the surface of the ground, as obviously would be desirable for high-speed operations.

At this point it is perhaps appropriate to say that while the need for ground-reinforcement has been described above in a military context, there are of course similar situations encountered in peacetime as well as in war, for instance in the heavy civil construction industry, where very major work-sites are created by ground-excavation, ground-filling and ground-levelling operations, and it is necessary for long periods of many months or even years for earth-working and other heavy machinery to be moved around the work-site.

Nor indeed are these military and civil engineering contexts the only ones where temporary (or even semi-permanent) ground-reinforcement systems are needed. Wherever there is to be a great but short-lived congregation of people (and the vehicles in which they arrive and leave) the same kind of problem is liable to be encountered, and of course especially during periods of the year, e.g. Winter, when the ground becomes saturated with water and thereby loses its full load-bearing capacity. This kind of short-lived need for hard-standing may arise on the occasion of things such as horse-race meetings and other open-air sporting events, or indeed at gatherings such as agricultural shows and so on.

Whatever the event, if it is to be held in the open air with a possibility of wet weather there is a requirement (at present more or less unfulfilled) for a ground-reinforcement system which:

(a) can be quickly and economically laid down before the event;

(b) will during laying accommodate itself reasonably adequately to undulations in the underlying terrain;

(c) will after it has been laid withstand the maltreatment it receives not only from large crowds of people but also from the vehicles in which they arrive and leave;

(d) will when laid restrict the damage suffered by the underlying terrain, e.g. a grass sward when shut out from light and rain for the period of the event; and (e) can after the event be recovered (for re-use on another occasion) more or less as speedily and economically as it was first laid down.

So far as is known there has till now been no ground-reinforcement system which can adequately meet these various requirements, but they are attainable by means of the procedures which have been devised and form the basis of this invention.

The genesis of the present invention lies in recognizing that the key to the problem here confronted and solved lies in evolving an interlock mechanism for use between adjacent, heavy-duty ground-reinforcing panels which is simultaneously sturdy enough to withstand the sometimes extreme horizontal stresses imposed upon it by vehicular traffic, and yet which is flexible enough to allow considerable vertical displacement of one panel out of the plane of its adjacent panels to such an extent that simultaneously on the one hand it is possible for the ground-reinforcement to accommodate itself to significant undulations in the underlying terrain and on the other hand it is possible for the ground-reinforcement to arrive at the site in a roll, to be laid out upon the ground surface by simply unrolling that roll, and afterwards to be recovered by rolling it up again.

According to the invention there is provided a generally-planar ground-reinforcement panel, for use in an articulated sequence or array of such panels, the boundaries of said panel including at least one pair of parallel rectilinear edges, said pair of edges being provided with respectively a number of male interlock members projecting therefrom in the plane of the panel and a corresponding number of female interlock members recessed therein, the arrangement being such that (a) the male member(s) on the edge of the panel may be forcibly but detachably engaged in a direction vertical to the plane of the panel with the female member(s) in the edge of another such next-adjacent panel but cannot be disengaged therefrom in the horizontal plane of the panels, and that (b) the male and female members are so constructed that when inter-engaged they are capable of limited rotation with respect to each other so that the panel is interlocked hingedly with a similar next-adjacent panel.

It is, of course, always implicit in this invention that the male and female members on next-adjacent panels will be properly positioned and adapted to mate with each other.

In a practical and currently-preferred construction of ground reinforcement panel according to this invention each male member associated with one of the edges of the panels comprises a spigot projecting longitudinally from its associated panel-edge and lying in the plane of said panel, said spigot at or adjacent its end remote from the panel-edge being provided with at least one transverse, generally-prismatic lug lying also in the plane of said panel, and each female member associated with the other edge of the panel comprises a generally-prismatic chamber recessed there within and disposed substantially parallel thereto, which chamber is able to accommodate the transverse lug(s) upon the spigot, at least one or other of the generally-prismatic lug(s) and chamber being truly cylindrical or at least part-cylindrical so that the lug(s) and the chamber may be rotated the one relative to the other about their common prismatic axis.

The term "generally prismatic" is used herein to embrace not only its obvious meaning of a multi-faceted generally-cylindrical prism but also even (and indeed especially) the extreme case where the number of facets approaches infinity and one arrives at a truly cylindrical (or part-cylindrical) surface.

The crucial requirement for the purposes of the present invention is that the lug(s) on the spigot should be accommodated within the chamber at least to some extent rotatably there within, and that the lug(s) and the facing chamber surfaces should co-act as bearing surfaces to hold the adjacent panels together even against quite considerable tensional stresses in the horizontal plane. Those two requirements can be met when, as previously envisaged, only one of the mating surfaces of respectively the lugs and the accommodating chamber is truly cylindrical, whereas the other is a multi-faceted prism proper. However, it will readily be understood that for the greatest efficiency and least possibility of wear-damage it is highly desirable for the co-acting surfaces of the respective lug(s) and chamber to mate as fully as possible—and it is therefore a much preferred feature of the construction of this invention that both said lug(s) and said chamber shall have truly cylindrical co-acting surfaces, at least in the direction in which horizontal tensional stresses will during normal usage be applied to and resisted by these co-acting bearing surfaces.

The generally-prismatic chamber within one plate-edge communicates with the edge of the plate via a relatively-narrow slot in said edge, through which can pass only the spigot but not the lug(s) of the male member in a range of angular orientations between the prismatic lug(s) and the prismatic chamber.

The prismatic chamber also communicates with at least one face of its associated panel via an elongate aperture parallel to the panel-edge, said elongate aperture having substantially the same length as that of the prismatic lug(s) and through which said lug(s) can be introduced into said chamber.

The elongate aperture in the face of the panel and the relatively-narrow slot on the edge thereof communicate with each other on at least one of the faces of the panel associated with the female member(s), so as to permit introduction of the spigot-mounted lug(s) within the chamber, and means are provided whereby after insertion of the spigot-mounted lug(s) within the chamber said lug(s) are to at least some extent hindered from exiting from said chamber when the respective next-adjacent panels lie in substantially the same plane.

In order to achieve the objectives of this invention it is necessary that the male and female members must lie within the plane of the panels and be inseparable in that plane, while also being both inter-engagable and disengagable (when desired) in directions perpendicular to that plane . . . but additionally it is also necessary to provide means for hindering unwanted accidental disengagement during normal use.

These requirements can be achieved in various ways, somewhat dependent on the nature of the materials from which the panels (and hence the female member) and/or the male member are formed, and also indeed the manner in which the ground-decking panel array system is to be constructed (e.g. manually or mechanically) and thereafter dismantled.

However, it is currently envisaged and preferred that the panels shall be completely or substantially-completely (e.g. with the possible exception of the male member) formed of injection-moulded plastics material, e.g. a fairly rigid but to some limited extent resiliently-flexible and very desirably fire-retardant grade of a suitable plastics material, including for instance polyvinylchloride, polyethylene or polypropylene, but above all acrylonitrile butadiene styrene (ABS)

In that event it is feasible and very convenient to provide disengagement hindering means in the form of projections or lips arranged along one or both sides of the elongate aperture which reduce its effective width to somewhat less than the diameter of the cylindrical lug(s), so that the lug(s) can be introduced within the chamber (even when both next-adjacent panels are lying in substantially the same plane) only by forcing them through the elongate aperture against the resilient bias of those projections or lips, thus by making a force-fit between the male and female members. And conversely, the male member once thus mated with the female member cannot easily slip out of engagement, since it then can be disengaged only by overcoming the retaining bias of the same projections or lips along the elongate aperture.

In an alternative arrangement, thought to be preferable for reasons of convenience, in moulding operations, the lips are omitted and instead the disengagement hindering means take the form of an integrally-moulded, upstanding, resiliently flexible catch which is flexed into a recess so as to admit the male member into mating engagement with the female member, but thereafter springs back to hook over the upper surface of the male member and thereby hinder it from exiting from mating engagement.

While other arrangements are of course feasible, obviously for most purposes it is highly desirable that the whole arrangement should be symmetrical. Therefore the spigot of the male member(s) projecting from one panel-edge and the access slot of the female member(s) recessed into the other panel-edge will normally be both directed at right-angles to said respective edges, while the end of the spigot is provided with two similarly-dimensioned but oppositely-directed generally prismatic lugs, one on either side thereof, the prismatic axis of said lugs being at right angles to the spigot-axis but in the plane of the panel so that when the male and female members on next-adjacent panels are interlocked the prismatic axis of the lugs is substantially co-incident with the axis of the prismatic chamber.

Since the male and female members on next-adjacent panels must be properly-adapted to mate with each other, when there are two opposed but otherwise similarly-dimensioned lugs on the end of and transverse to the spigot then the relatively-narrow slot will be positioned centrally of the prismatic chamber.

In the currently-envisaged preferred construction of panel in accordance with this invention both the spigot and the two transverse lugs mounted thereon are formed of circular cross-section rod having the same diameter. Bearing in mind that the full tensional stresses between next-adjacent panels in a sequence or array have to be borne by the spigot of the male member, it may be preferable if the spigot and lugs are formed of metal, e.g. steel rod having an adequate tensile strength for the intended usage.

The length of each lug along its prismatic axis transverse to the spigot-axis will very conveniently be substantially the same as the width of the slot through which the spigot enters the chamber.

It will naturally be understood that the panels of this invention can be laid and lifted manually, one at a time; and indeed if a panel in a sequence or array becomes damaged it will be necessary to replace it by hand. It is nevertheless one of the important objectives of this invention to enable and facilitate the laying and lifting of a sequence of articulated panels in a roll, and for that purpose they must be capable of tilting hingedly relative to each other.

It is therefore an almost fundamental requirement of the panels of this invention that one of the pair of parallel edges is associated only with one or more male member(s) projecting therefrom and the other of those edges is associated only with one or more corresponding female member(s) recessed there within.

It will be appreciated that since the male member must enter the female member in the vertical direction but the two of them co-operate to withstand tensional stresses in the horizontal direction the access slot and the elongate aperture must be able to accommodate rotation of the spigot-mounted lug(s) relative to the chamber of substantially 90°. However in order to permit an articulated panel sequence or array to accommodate itself to significant undulations in the underlying terrain and/or to permit the panel sequence to be rolled up either way (i.e. with either the top or the bottom of the panels on the outside of the roll) it is very desirable that the edge-communicating slot is recessed into its associated panel-edge, sufficiently to permit rotation of the spigot and lug(s) relative to the chamber through an angle of more than 90° (between horizontal and vertical planes) and preferably of between 135° and 180°.

The panel will preferably be bounded by two pairs of parallel rectilinear edges, and thus be rectangular in plan. It is desirable that there should be a plurality of male and female members spaced apart symmetrically along each rectilinear panel-edge, conveniently in pairs or larger multiples of two.

As thus far described, this invention has been primarily concerned with the interlock mechanism between next-adjacent panels in a sequence or array, and indeed it is centred there—but it does of course have other features of a highly preferred nature besides those relating simply to that interlock mechanism. While it is broadly-true that any ground-decking articulated panel system when interlocked by the mechanism already described should be capable of withstanding the horizontal tensional stresses imparted to it by vehicular traffic thereon, it will be appreciated that there are various possibly-differing requirements for the exact nature of the panels best employed for one kind of end-purpose or another.

Merely to illustrate this point, there are clearly some situations (e.g. where a short-lived event requires quite temporary ground-reinforcement over grass sward) where it is undesirable to exclude light, air and water too completely from the underlying grass else otherwise it will be damaged—and yet there are other situations (e.g. on a large, excavated heavy-construction work-site) where no such considerations apply, but there is much to be gained by constructing the panels in a way which to a large extent excludes the penetration of rain and indeed tends to shed it.

These conflicting requirements may lead to the need for different kinds of panel-surface, and yet manufacturing economics must demand the greatest possible degree of manufacturing uniformity.

It is therefore a greatly preferred feature of this invention to provide a generally-planar ground-reinforcement panel, of the kind hereinabove disclosed, which comprises a rectangular, generally-planar, substantially rigid framework and an upper decking plate supported by and secured to one side of the planar framework, the framework comprising a rectangular peripheral frame and within said frame a number of load-transfer struts intersecting with the peripheral frame so as to distribute load applied to the decking plate appropriately across the entire framework and via the peripheral frame and the intersecting load-transfer struts to the underlying ground upon which the panel is to be placed.

It is of course possible for the decking plate to be integrated with the framework, as by moulding the framework from plastics material with the decking plate in situ.

Alternatively, it is however possible at the stage of manufacture to make a standard framework panel, but to equip it with alternative decking plates according to the end use envisaged. Usually the choice lies broadly-speaking between perforate decking plates which will admit light, air and water to the underlying ground and non-perforate ones which will not. In this case there must be means for securing the chosen decking plate to the standard framework. Such securing means can advantageously take the form of a plastics or metal locking key, insertable through a centrally-located hole in the decking plate and engageable with (but usually not disengagable from) a boss disposed centrally of the intersecting struts within the peripheral frame of the panel.

Perhaps unexpectedly, it is an important feature of this invention that the decking plate (on its outer surface) should be relatively non-reflective. From whatever material the decking plate is formed its surface therefore should be roughened or otherwise treated to reduce its light reflectivity. The currently preferred decking plates, for their combination of strength with lightness, are those formed of appropriate aluminium alloys—and the upper surface of such aluminium plates is advantageously rendered relatively non-reflective by surface-indentation and/or embossing of that surface with a so-called "chequer-plate" pattern.

The ground-reinforcement panels described above are for many or even most purposes perfectly satisfactory as they stand, but when they are expected to carry very heavy traffic, especially over ground of suspect compressive strength, they can be further improved in their load-bearing capacity by providing the lower surface of the panel (remote from the decking plate) with a soil compression unit.

It is therefore a still further and for some purposes much preferred feature of this invention to provide a generally-planar ground-reinforcement panel, of the kind hereinabove disclosed, which on its ground-contact face bears a multiplicity of soil-compactor spikes adapted under load to penetrate the underlying ground and thereby to compress and compact it therebetween. The soil-compactor spikes will preferably be generally-pyramidal, a term which includes other multi-faceted, even conical and/or irregular shapes akin to a true pyramid, and no matter whether the facets thereof be planar or instead either somewhat concave or convex.

Where the panel is, as preferred, a framework as described above equipped with an upper decking plate, the ground compression unit will preferably be a moulding which on its lower surface provides the multiplicity of soil-compactor spikes but on its upper surface is shaped to fit snugly, and at best exactly and completely, within the interstices between the peripheral frame and intersecting load-distribution struts underneath the panel framework, and to abut against the underside of the decking plate secured thereto.

The upper surfaces of the ground compression unit and the underneath surfaces of the panel framework will very desirably be provided each with co-acting means whereby the compression unit may be snap-fitted below the panel beneath the panel.

The soil compression unit will advantageously be moulded from a rigid-foamed plastic material, e.g. rigid polyurethane foam, and then will desirably be encased in water-impermeable sheet-material, e.g. a blow-moulded polyvinylchloride skin.

The invention of course extends to an essentially uni-dimensional sequence of such panels, adapted to be rolled out onto the ground and thereafter rolled up again so as to lift it from the ground.

It extends also to two-dimensional arrays of such panels, and especially such arrays when formed by juxtaposing and inter-connecting the above-mentioned uni-dimensional panel sequences side by side.

In order that the invention may be well understood it will now be described, in more detail but only by way of illustration, with reference to the accompanying drawings, in which.

Figure 14:
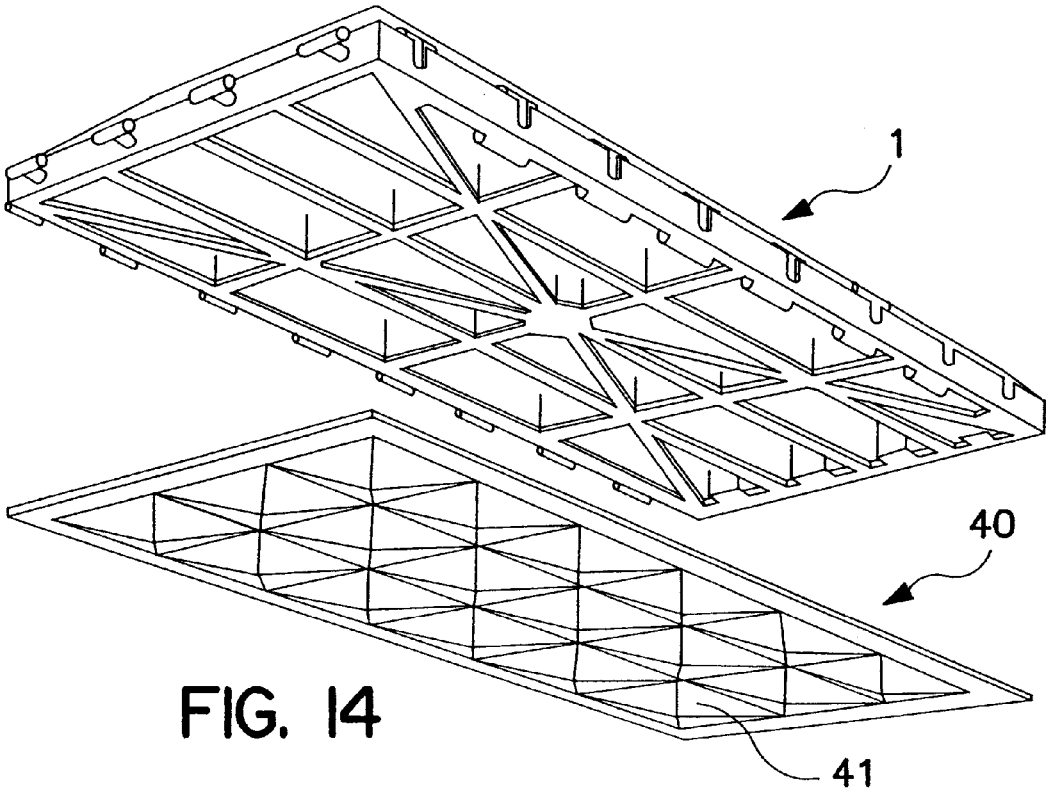
FIG. 14 is an exploded, perspective view of the panel of FIG. 13, but with a schematically-illustrated soil-compression unit ready for attachment thereto.
Figure 15:
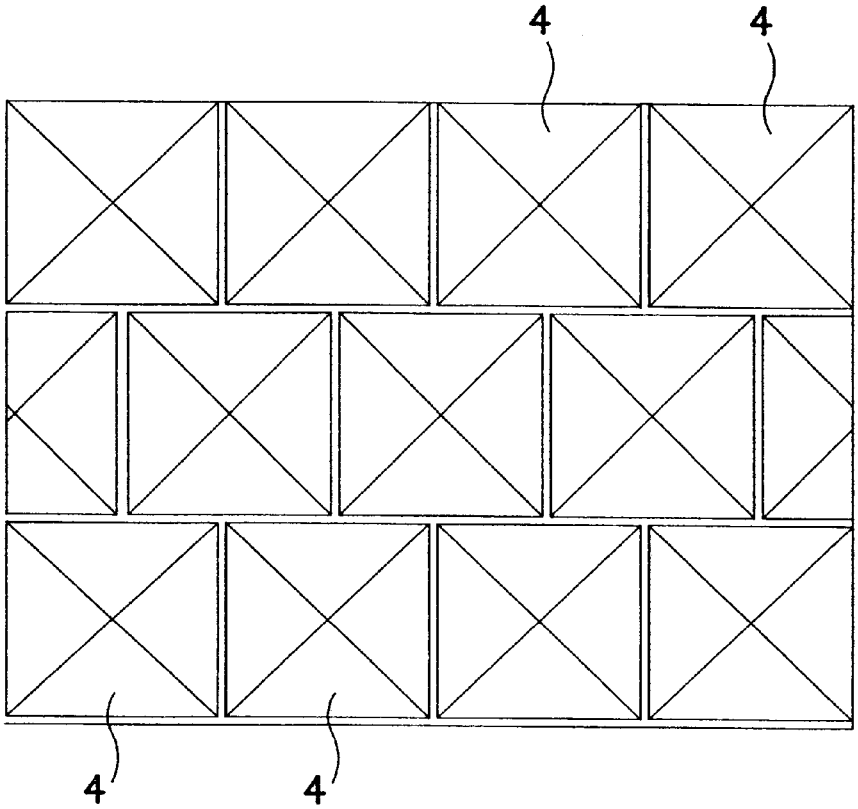
Figure 16:
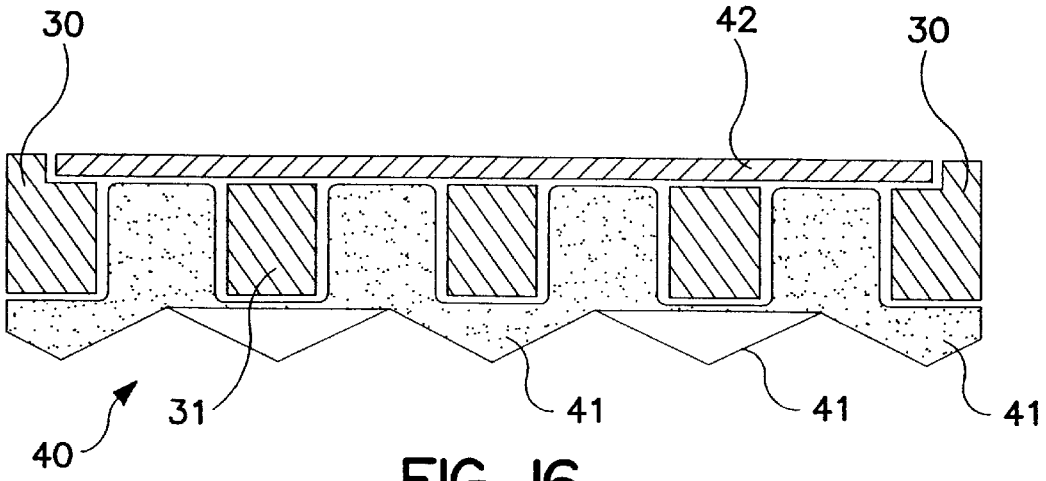

FIG. 15 is an underneath plan view if part of a soil compression unit generally similar to that illustrated in FIG. 14 but with a preferred pattern of soil-compactor pyramidal spikes arranged thereon; and FIG. 16 is a schematic, vertical part-sectional view through a heavy-duty panel which is intended merely to illustrate the preferred manner in which the soil-compression unit is fitted snugly within the panel below the panel-decking plate.

Figure 1:
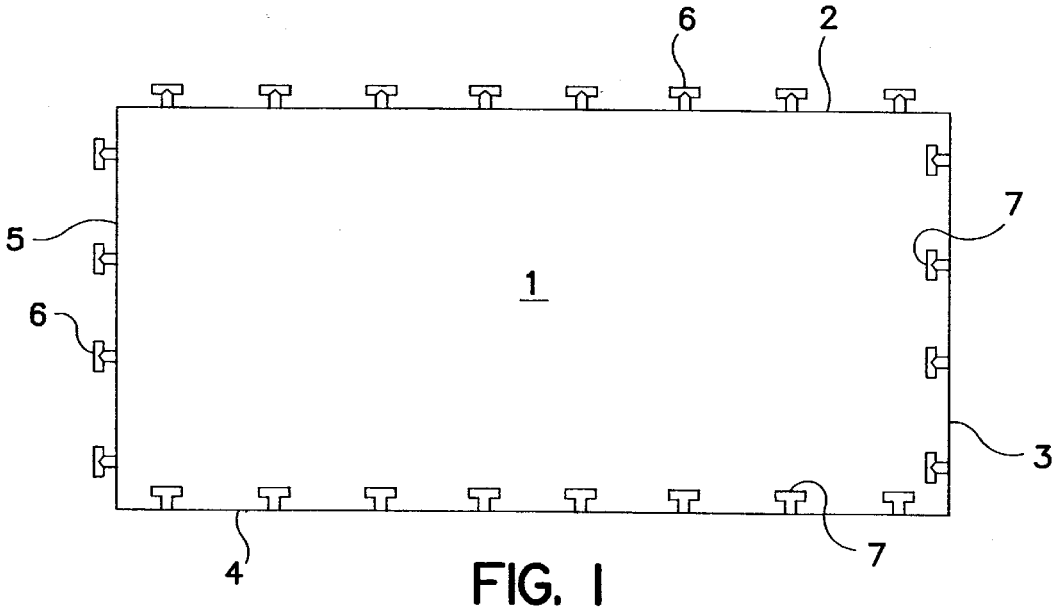
FIG. 1 shows a somewhat schematic plan view of a simple embodiment of ground-reinforcement panel in accordance with this invention.

Referring first to FIG. 1 this rather schematically shows a ground-reinforcement panel generally indicated 1 of rectangular outline, typically 2 feet wide by 1 foot long (or comparable metric measurements, e.g. 50 centimeters wide by 25 centimeters long) which is bounded by rectilinear edges indicated 2, 3, 4 and 5. Associated with 2 and 3, which are arranged at right-angles to each other, there is a series of T-shaped male interlock members 6, eight of them spaced symmetrically along edge 1 and four of them along edge 4. Associated with the other edges 3 and 4 (which are also arranged at right-angles to each other, but parallel to respective edges 5 and 2) there is a corresponding series of female interlock members 7, four of them spaced along and recessed within edge 3 and eight along and within edge 4.

Figure 2:
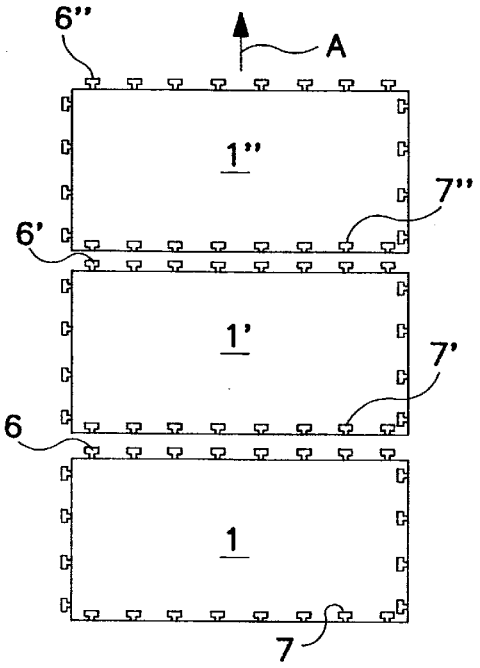
FIG. 2 shows an exploded, plan view of three next-adjacent such panels (as in FIG. 1 but on a reduced scale) in near-abutting relationship, ready for their respective male and female interlock members to be engaged with each other, so as to form an uni-dimensional sequence in the direction of arrow A.

As can be seen from FIG. 2, an essentially uni-dimensional sequence of such panels (1, 1', 1" . . . and so on) is formed in the direction of arrow A by interengaging the T-shaped male members 6 on panel 1 with the female members 7' on panel 1', then the male members 6' on panel 1' with the female members 7" on panel 1", and so on.

Figure 3:
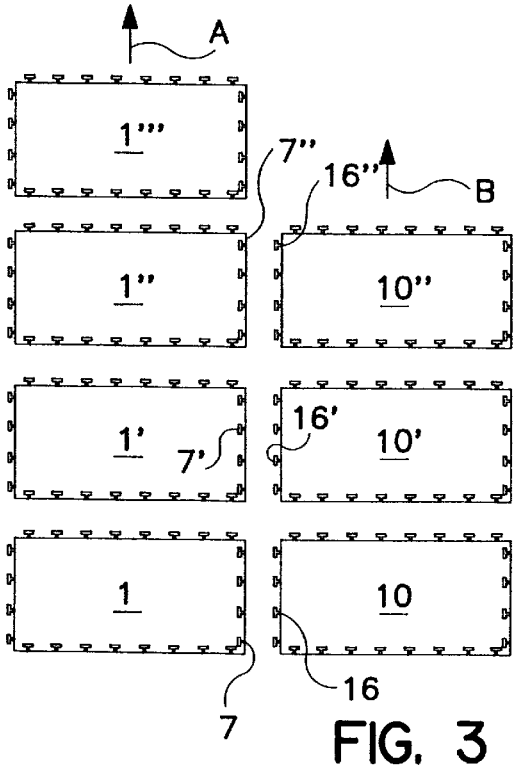
FIG. 3 is an exploded plan view (similar to FIG. 2, but on a still further reduced scale) of two such uni-dimensional sequences in the direction of respective arrows A and B juxtaposed side by side, ready for their lateral male and female interlock members to be engaged with each other so as to form a two-dimensional array.

And as appears from FIG. 3, when alongside the uni-dimensional sequence in the direction of arrow A (as illustrated in FIG. 2) there is juxtaposed a similar sequence of panels 10, 10', 10" (and so on) in the direction of arrow B, and the two juxtaposed sequences A and B are interlocked side-by-side by inter-engaging the male members 16, 16', 16" (and so on) of sequence B with the female members 7', 7', 7" (and so on) of sequence A, there is created a two-dimensional array of ground-reinforcement panels.

Figure 4:
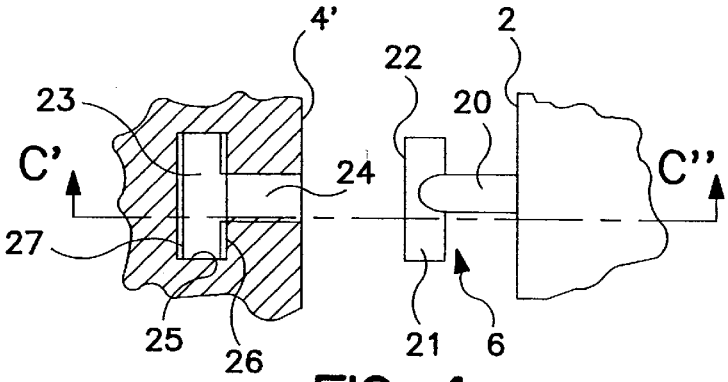
FIG. 4 shows in more detail a plan view of a male interlock member and an horizontal, partly-cross-sectional view through a female interlock member in near-abutting but not yet inter-engaged relationship.
Figure 5:
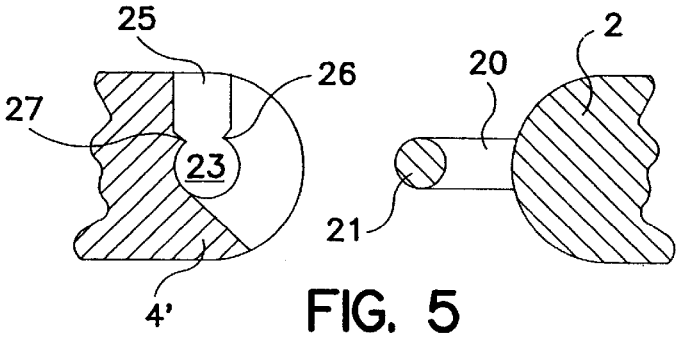
FIG. 5 shows a side-elevational view, partly in vertical cross-section (taken on the line C'-C" in FIG. 4) through the same, near-abutting but not yet inter-engaged male and female interlock members as shown in FIG. 4.

The respective male and female interlock members (of the panels, sequences and arrays of FIG. 1 to 3) are shown in more detail, but still only schematically, in the enlarged plan view of the near-abutting but not yet interlocked edges 2 and 4' shown in FIG. 4 and the vertical cross-sectional view therethrough (taken on the line X—X in FIG. 4) which is shown in FIG. 5. As will be seen the male interlock member 6 projecting from panel edge 2 comprises a spigot 20, lying within the plane of panel 2, which spigot 20 at the distal end thereof carries transverse lugs 21, 22 also lying in the plane of panel 2. The female member 7 recessed within panel edge 4' comprises a cylindrical chamber 23, with its axis parallel to panel edge 4' and able to accommodate the end of the spigot 20 and transverse lugs 21, 22. The cylindrical chamber 23 communicates with edge 4' through spigot-access slot 24, and it also communicates with the upper face of panel 4' through elongate aperture 25 within which and running down each side thereof are respective resiliently-flexible lips 26 and 27.

Figure 6:
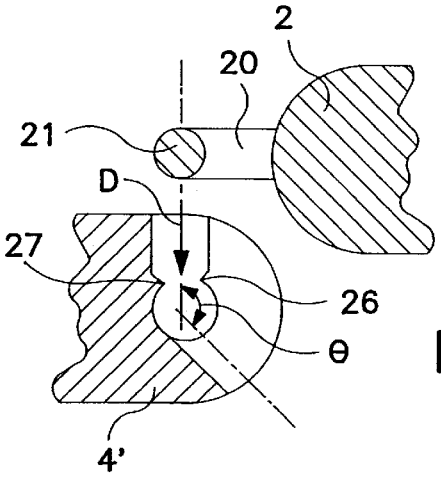
FIG. 6 illustrates the male and female members of FIGS. 4 and 5 when aligned ready for inter-engagement in the direction of arrow D.
Figure 7:
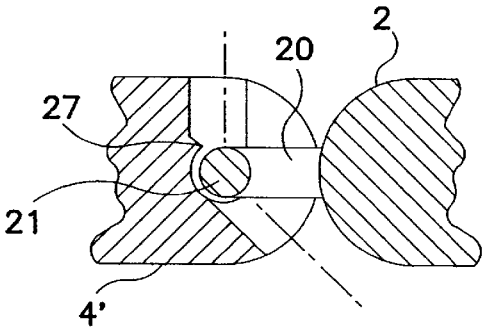
FIG. 7 shows the male and female members of FIGS. 4 to 6 when inter-engaged.
Figure 8:
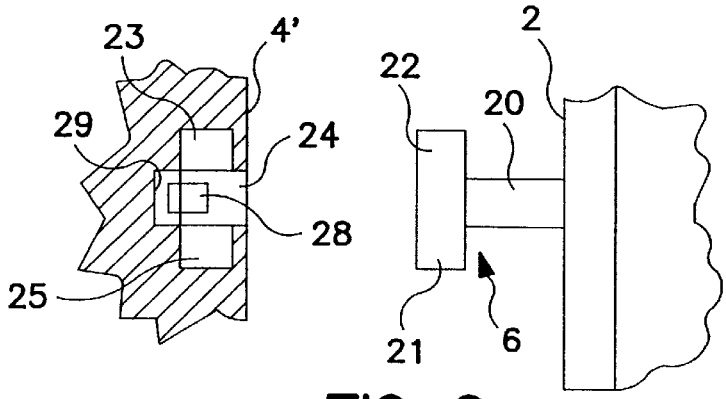
FIGS. 8 to 11 show views, corresponding to those depicted in FIGS. 4 to 7, of an alternative embodiment of interlock arrangement, which here includes a spring catch for releasably retaining the male and female members inter-engaged.
Figure 9:
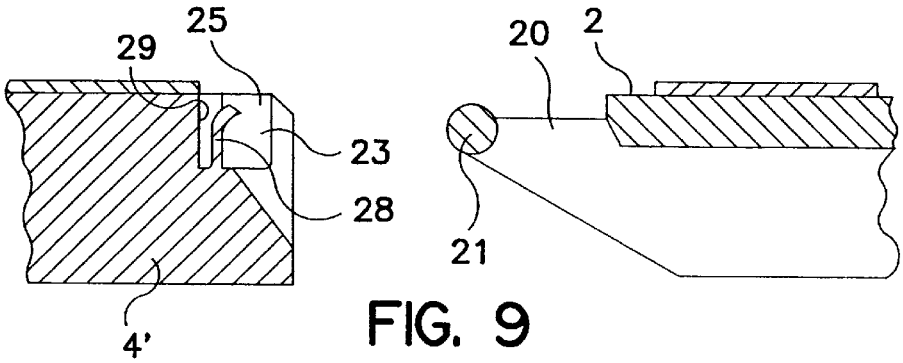
Figure 10:
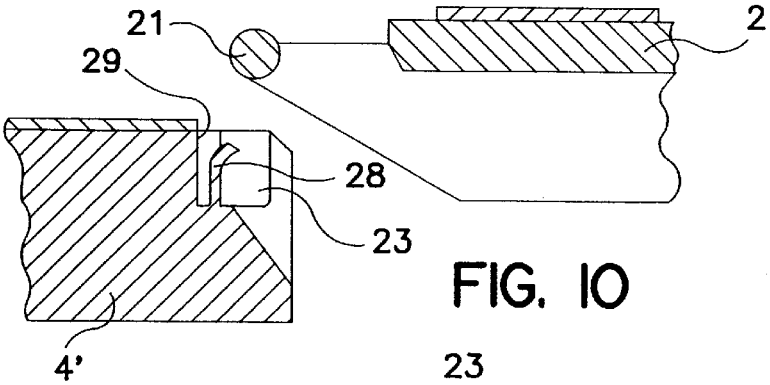

The manner in which the male member and female member are inter-engaged appears from the sequence shown in FIGS. 5, 6 and 7. In order to inter-engage the near-abutting panel-edges 2 and 4', (as shown in FIG. 4) the end of the male member is over-lapped with the other panel edge 4', and when the spigot 20 is vertically aligned with the spigot-access slot 24 the transverse lugs 21, 22 are also in alignment with the elongate aperture 25 so that the male member 20 can be dropped into the communicating aperture 25 and slot 24 in the direction of arrow D, and fitted into the chamber 23 by forcing the lugs 21, 22 past the resilient lips 26 and 27.

One thus arrives at the situation shown in FIG. 7, where the respective panel-edges 2 and 4', are effectively abutting against each other (and thus able to withstand compressional stresses arising between the panels) and are held against separation from one another by the lugs 21, 22 within the chamber 23. Since both the lugs 21, 22 and the chamber 23 are essentially cylindrical, the spigot 20 and the panel with which it is associated may be rotated out of the horizontal plane through the angle, which cannot be less than about 90°, but on the other-hand cannot be effectively more than about 180°, and is here shown with its usually preferred value of substantially 135°.

Figure 11:
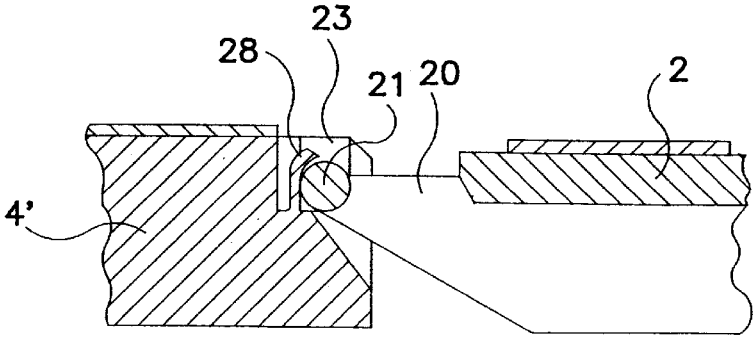

As already indicated, FIGS. 8 to 11 show views (essentially the same as those depicted in FIGS. 4 to 7, and in which the same reference numerals are used to identify similar parts) of an alternative embodiment, possibly better suited for fabrication by injection moulding techniques, in which the lips 26 and 27 (in FIGS. 4–7) are omitted, and instead there is provided an integrally-moulded, upstanding, resiliently-flexible catch 28 at the mouth of a recess 29 into which the catch 28 is forced back when the transverse lugs 21, 22 are forced downwardly into mating engagement with the chamber 23, but then springs back to hook over the lugs as shown in FIG. 11.

Figure 12:
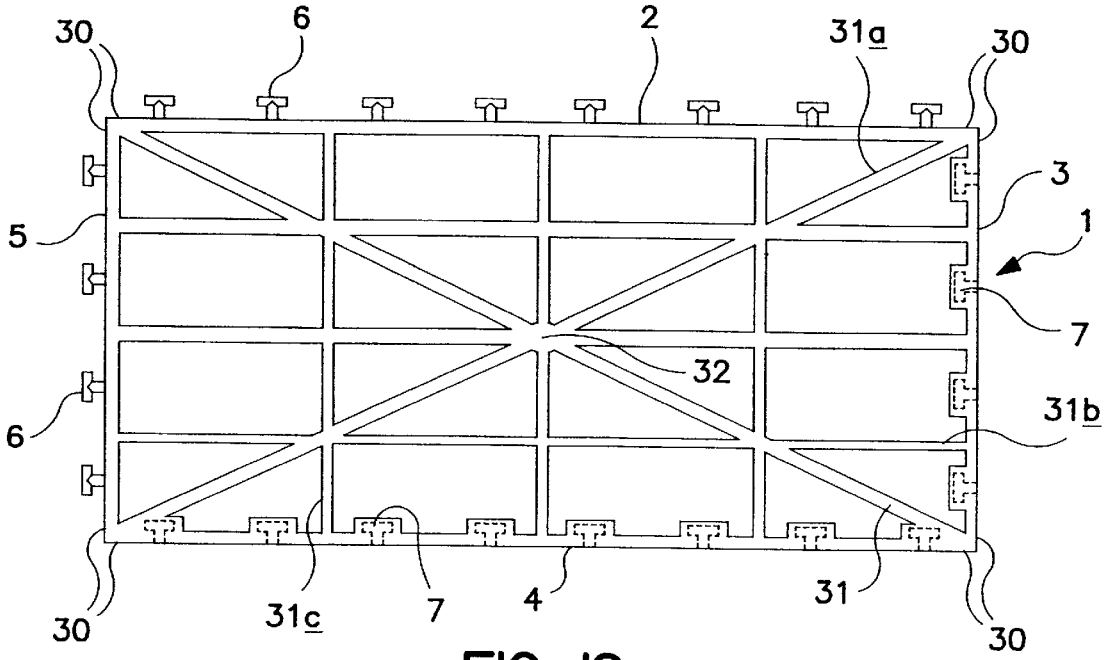
FIG. 12 shows an underneath plan view of one preferred embodiment of panel similar to schematic FIG. 1 but in more detail.
Figure 13:
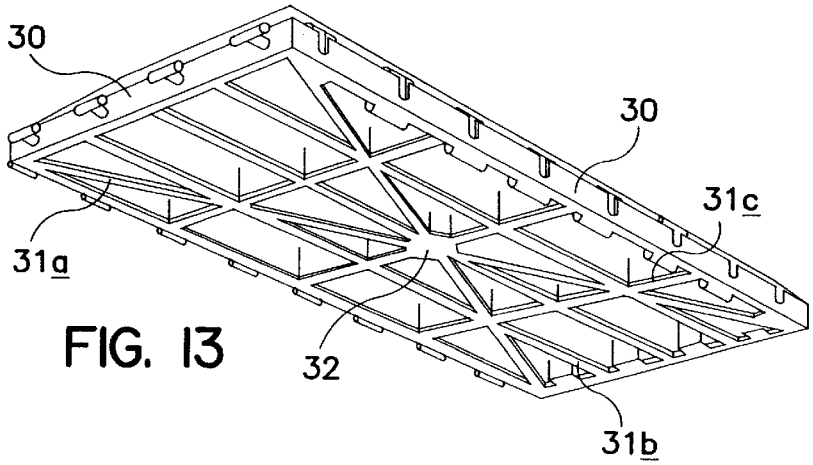
FIG. 13 shows a perspective view from below also illustrating one end and one side of the embodiment of FIG. 5.

Referring now to FIGS. 12 and 13, these illustrate some of the preferred features of the panels already described and schematically shown with reference to FIGS. 1 to 11. As will be seen from FIGS. 12 and 13, the rectangular panel generally indicated 1 is a framework comprising a rectangular peripheral frame 30 and within said frame a number of load distribution struts 31, which may be of any suitable design but are here shown in their currently-preferred arrangement of two diagonal struts 31*a* and three equidistantly-spaced intermediate struts 31*b*, parallel to edges 2 and 4, intersecting with another three equidistantly-spaced intermediate struts 31*c*. All of these struts 31 intersect with the peripheral frame 30, while the two diagonal struts 31*a* and the two median struts 31*b* and 31*c* intersect with each other at a central boss 32. As in FIGS. 1 to 11, panel-edges 2 and 5 are provided with a series of projecting male members 6, while panel-edges 3 and 4 have a corresponding series of female members 7 as recessed therewithin.

As appears best from FIG. 13, the intersecting struts 31 have the same depth as the peripheral frame 30 and thus any load applied to the upper decking plate (not here shown) is transmitted through both the peripheral frame 30 and the intersecting struts 31 to the ground-contact surface created by the bottom of the frame 30 and struts 31.

FIGS. 14, 15 and 16 show a further elaboration of the panel of FIGS. 12 and 13. As appears from FIG. 14, when desired (e.g. when rather heavy-duty panels must bear the weight of heavy vehicular traffic) the panel of FIGS. 12 and 13 can be additionally provided with a soil-compression unit, here shown in an exploded view and generally indicated 40, which of course in use is attached immediately adjacent and beneath the ground-contact faces of the frame 30 and intersecting struts 31. The soil compression unit 40 is provided with rows of downwardly-pointing pyramidal spikes 41, which when the panel equipped with the soil-compression unit 40 is put under load penetrate the underlying ground (not shown) and compress and compact it to improve its load-bearing capacity.

For simplicity of perspective illustration the soil compression unit 40 shown in FIG. 14 has rows of pyramidal spikes 41 which run in phase with each other, but preferably such rows of pyramidal spikes are arranged with each row out of phase with the next adjacent row by one half of one pitch, as illustrated in FIG. 15.

Moreover, while the upper surface of the soil-compression unit 40 may be planar (as it might be assumed to be in FIG. 14) it is preferred that, as shown in FIG. 16, its upper surface shall be moulded to fit snugly within the interstices between the peripheral frame 30 and the intersecting struts 31 in the panel frame-work, and indeed effectively to fill those interstices so that the uppermost surfaces of the moulded soil-compression unit 40 abut against the under-surface of an aluminium panel decking plate 42, thus ensuring that loads applied to the latter are transmitted as evenly as possible to the soil compression unit.

What is claimed is:

1. A generally planar ground-reinforcement panel, for use in an articulated sequence or array of such panels, the boundaries of said panel including at least one pair of parallel rectilinear edges, said pair of edges being provided with, respectively, a number of male interlock members located on one of the edges and projecting therefrom in the plane of the panel, and a corresponding number of female interlock members located on the other edge and recessed therein, the arrangement being such that (a) the male member(s) on said one edge of the panel may be forcibly but detachably engaged in a direction vertical to the plane of the panel with corresponding female member(s) in an edge of another such next-adjacent panel but cannot be disengaged therefrom in the horizontal plane of the panels, and that (b) the male and female members are so constructed that when interengaged the male and female members are capable of limited rotation with respect to each other so that the panel is interlocked hingedly with a similar next-adjacent panel.

2. A panel as claimed in claim 1, in which each male member comprises a spigot projecting longitudinally from said one edge and lying in the plane of said panel, said spigot having at least one transverse, generally-prismatic lug lying also in the plane of said panel, said lug being provided at or adjacent a spigot end which is remote from said panel edge, and each female member associated with the other edge of the panel comprises a generally-prismatic chamber recessed there within and disposed substantially parallel thereto, which chamber is able to accommodate a transverse lug(s) upon a spigot projecting from a next-adjacent panel so that the prismatic surfaces of the lug(s) of one panel and the chamber of a next-adjacent panel co-act as bearing surfaces, at least one or other of the generally prismatic lug(s) and chamber being truly cylindrical or at least part-cylindrical so that the lug(s) and the chamber may be rotated, one relative to the other about their common prismatic axis.

3. A panel as claimed in claim 2, in which both said lug(s) and said chamber have truly cylindrical or part-cylindrical co-acting bearing surfaces at least in the directions in which tensional stresses will be applied thereto during normal usage.

4. A panel as claimed in claim 2, in which the chamber within said other panel-edge communicates with said other edge of the panel via a relatively-narrow access slot in said other panel-edge through which only the spigot but not the lug(s) of the male member can pass in a range of angular orientations between the prismatic lug(s) and the prismatic chamber, and in which the prismatic chamber within said other panel-edge communicates with at least one face of its associated panel via an elongate aperture parallel to said other panel-edge, said aperture having substantially the same length as that of the prismatic lug(s) and through which said lug(s) can be introduced into said chamber.

5. A panel as claimed in claim 4, in which the elongate aperture in the face of the panel and the relatively-narrow slot in the edge thereof communicate with each other on at least one of the faces of the panel associated with the female member so as to permit introduction of the spigot-mounted lug(s) within the chamber, and exit hindering means are provided whereby after insertion of the spigot-mounted lug(s) within the chamber said lug(s) are to at least some extent hindered from exiting vertically from said chamber when the respective next-adjacent panels lie in substantially the same plane.

6. A panel as claimed in claim 1 formed substantially of injection-molded fire-retardant plastics material.

7. A panel as claimed in claim 5, in which the exit-hindering means comprise projections formed of resiliently-flexible plastics material arranged along one or both sides of the elongate aperture which reduce its effective width to less than the diameter of the lug(s), so that the lug(s) can be engaged and disengaged with the female member only against the resilient bias of said projections.

8. A panel as claimed in claim 7, in which the exit-hindering means comprise an integrally-molded, upstanding, resiliently-flexible catch which is flexed into a recess so as to admit the male member into mating engagement with the female member but thereafter springs back to hook over the upper surface of the male member and thereby hinder it from exiting from mating engagement.

9. A panel as claimed in claim 2, in which the spigot of the male member projecting from one panel-edge and the access slot of the female member recessed into the other panel-edge are both directed at right angles to said respective edges, while the end of the spigot is provided with two similarly dimensioned but oppositely-directed generally-prismatic lugs, one on either side thereof, the prismatic axis of said lugs being at right angles to the spigot-axis but in the plane of the panel so that when the male and female members on next-adjacent panels are interlocked the prismatic axis of the lugs is substantially co-incident with the axis of the prismatic chamber, both the spigot and the transverse lugs mounted thereon being preferably formed of circular cross-section rod, desirably formed of metal, having the same diameter.

10. A panel as claimed in claim 2, in which the length of each lug along its prismatic axis which is transverse to the spigot-axis is substantially the same as the width of the slot through which the spigot enters the chamber.

11. A panel as claimed in claim 2, in which:

one of the pair of parallel edges is associated only with one or more male member(s) projecting therefrom and the other of those edges is associated only with one or more corresponding female member(s) recessed therewithin;

the edge-communicating slot is fully-recessed into one face and at least partly recessed in the other face of said panel-edge so as to permit rotation of the spigot and lug(s) relative to the chamber through an angle of 135° to 180°;

the panel is bounded by two pairs of parallel rectilinear edges and thus is rectangular; and a plurality of said male and female interlock members are spaced apart symmetrically along each rectilinear panel-edge.

12. A generally-planar ground-reinforcement panel as claimed in claim 1, which comprises a rectangular, generally-planar, substantially rigid framework and an upper decking plate supported by and secured to one side of the planar framework, said framework comprising a rectangular, peripheral frame and within said frame a number of load-transfer struts, intersecting with the peripheral frame so as to distribute load applied to the decking plate appropriately across the entire framework and via the peripheral frame and the intersecting load-transfer struts to the underlying ground upon which the panel is to be placed.

13. A generally-planar ground-reinforcement panel as claimed in claim 12, in which the lower surface (remote from the decking plate) of said panel is equipped with a soil compression unit, preferably one which on its ground-contact face bears a multiplicity of soil-compactor spikes, preferably similarly-dimensioned, orderly-arranged pyramids, desirably arranged in orderly side-by-side rows in which the respective spike-sequences are out of phase by half of one pitch, said soil-compression unit being adapted under load to penetrate the underlying ground and thereby to compress and compact it therebetween.

14. A panel as claimed in claim 13, in which the soil-compression unit is a molding which on its lower surface provides the multiplicity of soil-compactor spikes but on its upper surface is shaped to fit snugly within the interstices between the peripheral frame and intersecting load-distributing struts of the panel framework, and to abut against the underside of the decking plate secured thereto.

15. A panel as claimed in claim 2, wherein said prismatic lugs and said chamber are cylindrical.

16. A panel according to claim 6, wherein said plastics material comprises acrylonitrile butadiene styrene.

17. A panel according to claim 5 in which said exit hindering means comprise at least one lip formed of resiliently-flexible plastics material arranged along at least one side of the elongate aperture which reduces its effective width to less than the diameter of the lugs so that the lugs can be engaged and disengaged with the female member only against the resilient bias of said lip.

* * * * *